United States Patent [19]

Rich

[11] Patent Number: 4,685,385

[45] Date of Patent: Aug. 11, 1987

[54] REFINISHING UNIT

[76] Inventor: Colin W. Rich, P.O. Box 98, Great North Road, Welwyn, Hertfordshire, England

[21] Appl. No.: 684,287

[22] Filed: Dec. 20, 1984

[51] Int. Cl.[4] ..... B05B 15/12

[52] U.S. Cl. ..... 98/115.2; 55/DIG. 46; 165/122

[58] Field of Search ..... 55/385 A, DIG. 46; 98/33.1, 115.2; 165/122; 118/326; 126/110 B, 110 D

[56] References Cited

U.S. PATENT DOCUMENTS

| | | | |
|---|---|---|---|
| 3,370,404 | 2/1968 | Leeper | 98/115.2 X |
| 3,395,972 | 8/1968 | Hardison | 98/115.2 X |
| 3,505,989 | 4/1970 | Trurlane | 55/385 A X |
| 3,611,907 | 10/1971 | Wasserman et al. | 98/31 X |
| 4,537,120 | 8/1985 | Josefsson | 98/115.2 |

FOREIGN PATENT DOCUMENTS

| | | | |
|---|---|---|---|
| 2110694 | 9/1972 | Fed. Rep. of Germany | 98/115.2 |

*Primary Examiner*—Harold Joyce
*Attorney, Agent, or Firm*—Anthony A. O'Brien

[57] ABSTRACT

A refinishing unit comprises an air handling module and a spray booth, both of which may be used separately. An air handling module suitable for use with a spray booth comprises a housing; fresh air inlet means to said housing; first fan means in said housing receiving fresh air from said fresh air inlet means; a heat generator in said housing; a heat exchanger in said housing, associated with said heat generator and through which air drawn in by said first fan means is passed; an outlet for heated air, heated in said heat exchanger, from said housing; an exhaust gas intake into said housing; second fan means in said housing and connected to said exhaust gas intake and outlet means exhausting gas, drawn in through said exhaust gas intake by said second fan means, to atmosphere. The spray booth comprises a roof structure unit and a floor structure unit, the roof structure unit being supported on the floor structure unit at suitable places by means of support columns.

1 Claim, 6 Drawing Figures

REFINISHING UNIT

BACKGROUND OF THE INVENTION

This invention relates to a refinishing unit.

Refinishing units are used particularly in the motor trade for the spraying of vehicles, particularly when carrying out accident repairs.

At present, refinishing arrangements usually consist of an expensive building unit built specially for the purpose or a costly adaption of an existing building in order to provide the necessary conditions for a spraying operation. As well as the spray booth itself, there are the various air handling and filtering arrangements which need to be of a large capacity and require fairly exact temperature controls for enabling curing of the spraying process.

SUMMARY OF THE INVENTION

It is an object of the invention to provide a refinishing unit which is readily put into operation without the need for costly building operations and which is provided with its own air handling and filtering systems.

It is a further object of the inventon to provide both an air handling module as an individual piece of apparatus and a spray booth useable therewith.

According to a first aspect of the invention, an air handling module suitable for use with a spray booth comprises a housing; fresh air inlet means to said housing; first fan means in said housing receiving fresh air from said fresh air inlet means; a heat generator in said housing; a heat exchanger in said housing, associated with said heat generator and through which air drawn in by said first fan means is passed; an outlet for heated air, heated in said heat exchanger, from said housing; an exhaust gas intake into said housing; second fan means in said housing and connected to said exhaust gas intake and outlet means exhausting gas, drawn in through said exhaust gas intake by said second fan means, to atmosphere.

According to a second aspect of the invention, a spray booth unit comprises a roof structure unit and a floor structure unit, the roof structure being supported on the floor at suitable places, particularly at the four corners, by means of support columns.

According to a third aspect of the invention, a refinishing unit comprises a spray booth of the type just referred to in combination with an air handling module as stated previously, the two units being of separate formation but being connected together on installation.

BRIEF DESCRIPTION OF THE DRAWINGS

The invention will now be described in greater detail, by way of example, with reference to the drawings, in which.

DESCRIPTION OF THE PREFERRED EMBODIMENT

Figure 1:
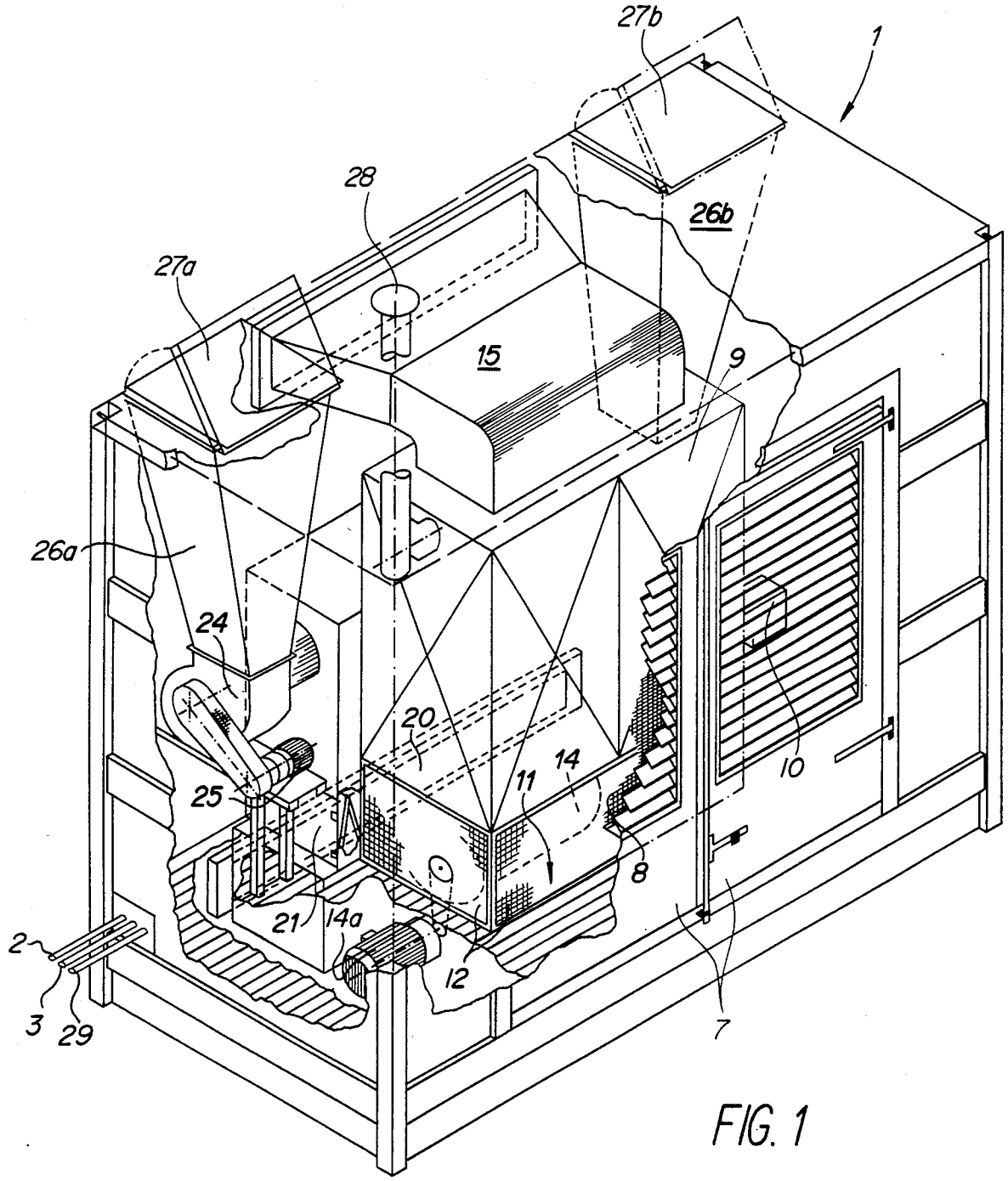
FIG. 1 is a schematic perspective view of one form of air handling module in accordance with the invention.

Referring firstly to FIG. 1, there is shown an air handling module 1 in the form of an apparatus pod which is self-contained and is connectable both to a spray booth which will be described hereafter and to sources of supply including mains electricity 2 and burner fuel such as gas or oil etc 3.

The apparatus pod or air handling module 1 comprises a steel housing framework 5 with panels 6. Access to the module is by a pair of double doors 7 suitably of louvered form with a mesh screen 8 behind. Since the pod will normally be used outside, the housing will normally be water and weatherproof. Basically the unit centres around a heat exchanger 9 to which air is fed and which is arranged to heat up this air by the use of an oil or gas burner 10 associated therewith.

Fresh air intake is provided through the mesh 8 of the doors 7 into the module. This air then passes through a three sided air intake 11 with filter screens 12 to ensure that no dust or other foreign matter carried by the intake air can pass into the heat exchanger system 9. The air from the intake filter passes directly to twin intake fans 14 (driven by electric motors one of which is shown at 14*a*) which takes the air and forces it upwardly through the heat exchanger 9 so that the air is heated up. This heated air is then passed outwardly at right angles from the top of the module through ducting 15. In order to conserve space, the change of air direction may be carried out by means of air turning vanes (not shown). Various sensors are provided for control purposes and the operation of these sensors will be described in connection with FIG. 4.

Exhaust air from the spray booth or other appratus is sucked in through a lower inlet duct 20, passes through a line of bag filters 21 and up through an extraction system having twin ducts 26*a*, 26*b*. The extraction system is driven by means of two fans, one of which is shown at 24, operated by an electric motor 25. These ducts 26*a*, 26*b* are closed at their upper end by means of a weighted flap valves 27*a*, 27*b* so that, when the module is not in use, the exit opening for the exhaust air is closed preventing the ingress of foreign matter back into the fan enclosure.

An exhaust flue 28 for the burner 8 is also shown. A control panel (not shown in this figure) is provided in the housing and may be provided with a long lead to enable remote control. Alternatively, a remote connection may be provided at 29.

Figure 2:
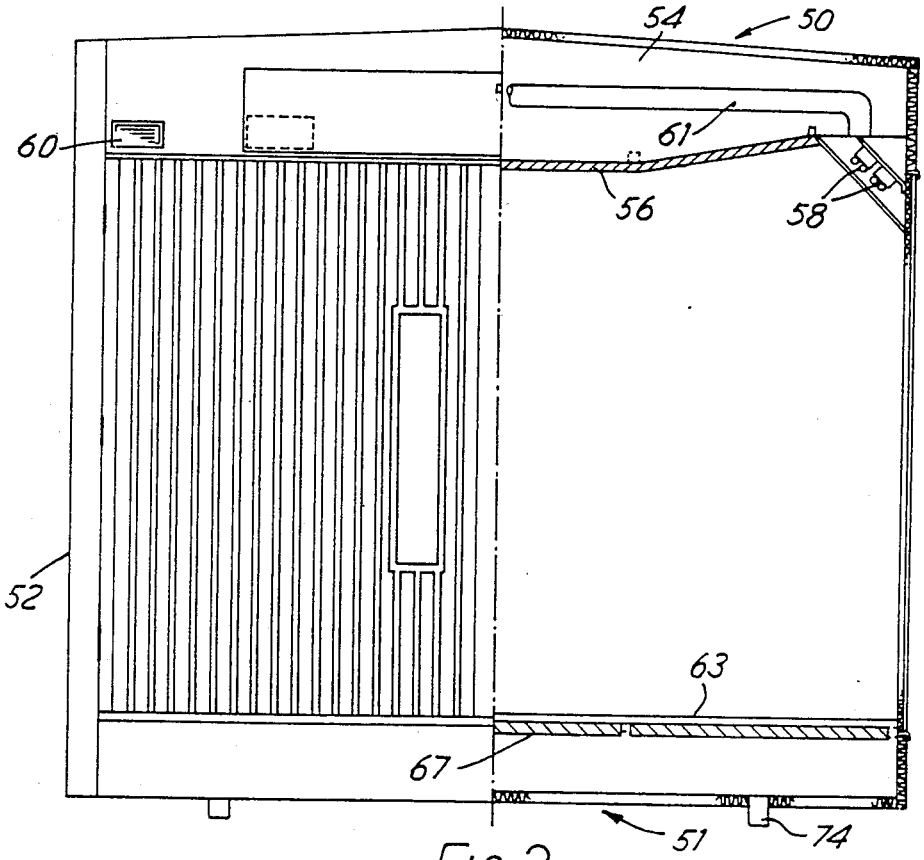
FIG. 2 is the partial end elevation and partial transverse section of a spray booth in accordance with the invention.
Figure 3:
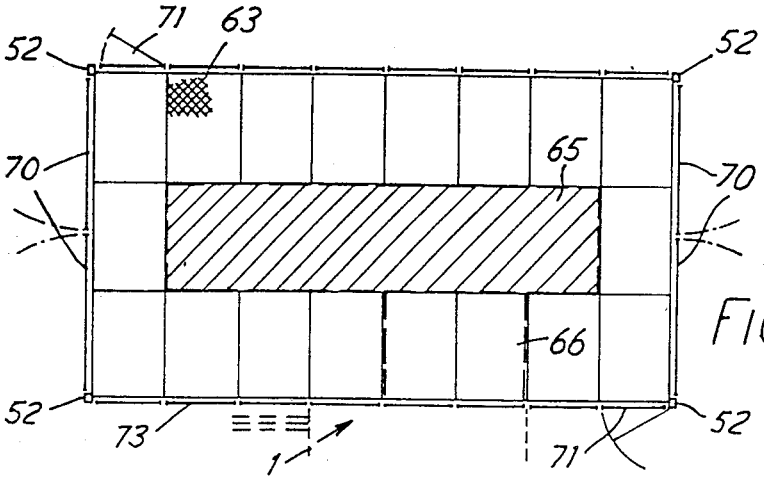
FIG. 3 is a plan view of the spray booth shown in FIG. 2.

Turning now to the construction of the spray booth, this comprises, as can be best seen from FIGS. 2 and 3, a two matress construction, namely a roof portion 50 and a floor portion 51 separated by a spacing pillars 52 at each of the four corners, the spacing pillars acting as the sole support of the roof portion 50. The roof portion itself comprises a large area input chamber 54 for heated air from the air handling module. This chamber 54 takes up most of the roof space, this space being closed by filter material 56 through which the incoming air passes providing both for filtering of any dust remaining in the air and also providing for diffusion of the air intake so that the air is distributed over the whole area of the spray booth. Two areas at the side of the roof portion carry fluorescent strip lighting 58, these being housed in ducts 59, which are provided with ventilation openings 60 and connecting ducts 61 so that the heat generated by the strip lights can be carried away and can, in certain circumstances, be used to add to the heat supplied by the air handling module.

The floor portion 51 of the spray booth suitably comprises a grid work 63 onto which a vehicle (64 in FIG. 4), for example, can be driven. The area which surrounds the position of the vehicle to be sprayed is provided as a separate area 65 and is connected by a duct 66 to an exhaust arrangement so that the air which is being used in the spray booth is drawn in around the bottom of the, for example, car and turbulance is thereby reduced. The remaining area of the grid is as stated separated from the exhaust area but is preferably provided with a grid which enables any foreign matter which is not sucked out during the air changes in the spray booth to be collected in the base of the spray booth from whence it can be emptied at suitable intervals. Underneath the grid work, which is preferably in the form of removable panels, filter material 67 is provided to remove the excess spray paint and other contaminants. The filter material may extend only over the area 65 or may extend over the whole floor area.

It will of course be appreciated that both the filters 54 in the roof portion 50 of the spray booth and the filter 67 situated in the floor portion 57 are removable and can be easily replaced when they become sufficiently contaminated.

The walls of the booth are formed of panels 69, which have no supporting function, merely acting to form an enclosure. Access doors 70 for, for example, vehicles, are provided at both ends of the booth and fire escape doors 71 are provided at diagonally opposite corners. A compressed air connection for the spray apparatus is provided at 73. It will of course be appreciated that since the booth will usually be located outside, its construction will normally be water and weatherproof.

The whole booth is suitably mounted on longitudinal skids 74.

The operation of the combined unit will now be described in connection with FIG. 4 of the drawings.

Figure 4:
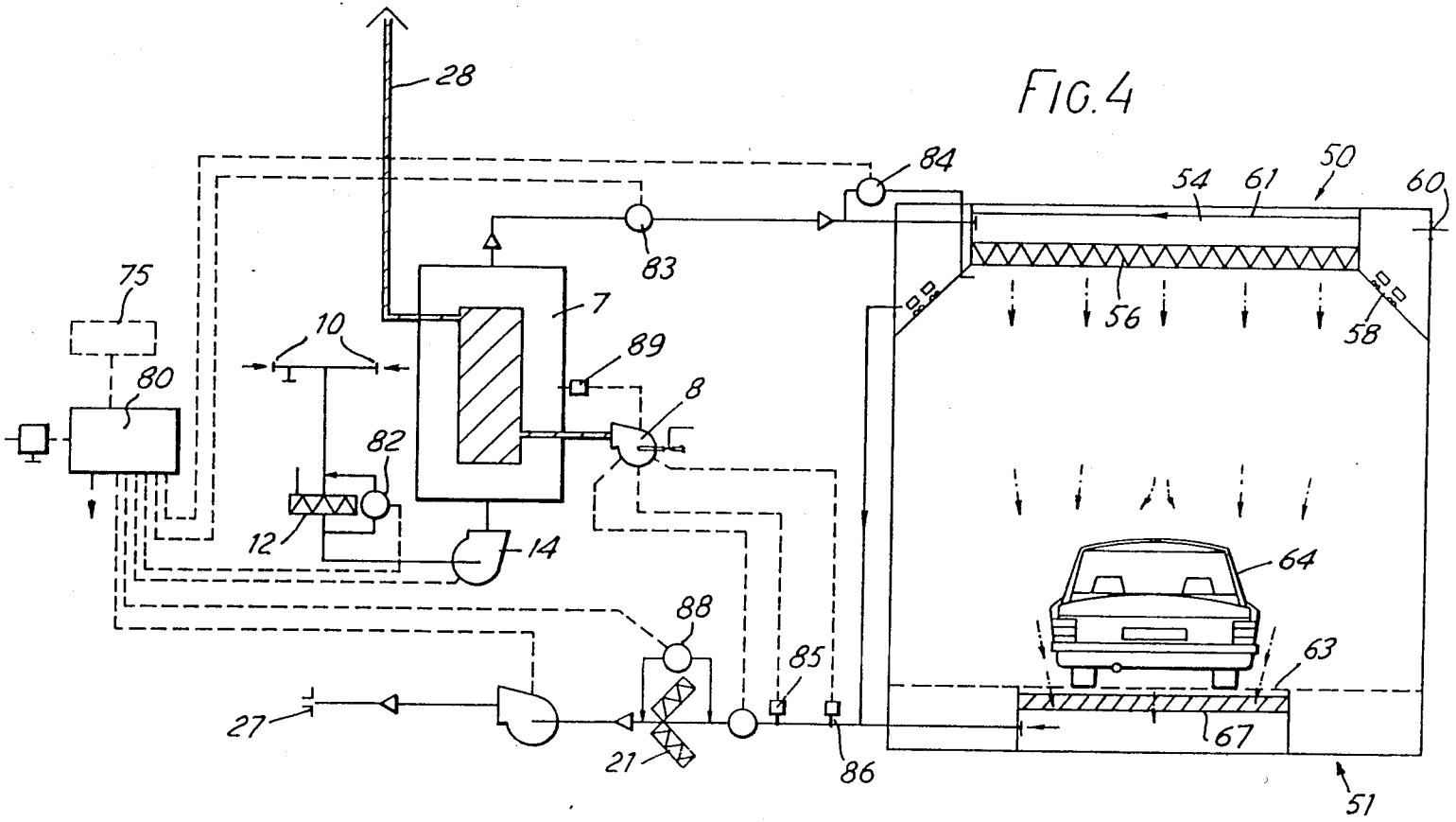
FIG. 4 is a schematic view showing the operative parts of the air handling module and the spray booth for explanation of the operation of the complete unit.

FIG. 4 provides a schematic diagram showing the operation of the refinishing unit, the parts of which have been described above.

The operation of any refinishing unit consists basically of two stages:

1. The spraying period during which a relatively large airflow is required so as to prevent any build up of spray mist in the booth and to provide a constant supply of fresh air for the operator.

2. A curing period during which the vehicle or other article being treated is heated to a relatively high temperature, normally in the region of 80° C., to provide curing of the sprayed on paint work. During this period, a considerably smaller air flow is required but the air required in the spray booth must be at a much higher temperature in order to provide the necessary heat for the curing operation.

Starting from the beginning of an operation, the vehicle or other article is placed in the booth so that it lies over the central region 65 of the grid work floor, i.e. over that part of the floor from which air extraction takes place. The apparatus is then started up, suitably using the remote control panel 75 connected to the main control panel 80 on the unit 1 the burner 8 being ignited and the fans 14 and 24 being started. Air flow from the fresh air intake louvres 16 is sucked through the intake filter 12 by the fan 14 and blown through the heat exchanger 7 for supply to the booth. The intake air filter 12 is provided with a pressure sensor 82 which senses the difference in pressure between both sides of the filter 12 and will provide an indication as to whether the filter is still in a useable condition or whether it has been blocked by the material being filtered out of the air supply. The flow of air passing out of the heat exchanger 7 is sensed by a first airflow sensor 83 which ensures that there is a sufficient amount of airflow through the ducts. The air then passes into the space 54 above the intake booth filters 56. At this point, during the spraying operation, the air should have a temperature of 22° C. and the air flow rate should enable a change of air in the booth to take place 3½ times a minute. This provides a booth temperature of 21° C. A second pressure sensor 84 is provided which senses a pressure difference between the incoming heated air and the booth pressure so as to check the state of the filters 56. The air then passes downwardly over the vehicle 64 or object being sprayed and is withdrawn through floor filters 67, for trapping any paint residue or other matter generated during the spraying operation.

The arrangement of the large area of filters 56 in the ceiling of the spray booth enables a very good distribution of the air over the whole of the spraying area of the booth and avoids turbulence in the air supply which would cause deflection of the paint spray and the accumulation of the paint residue in other parts of the booth.

The air then passes out of the spray booth into the air handling module and is there checked by two temperature sensors 85, 86, for high and low levels respectively. These sensors act directly on the operation of the burner 8. A second airflow sensor 87 is provided here, which also controls the operation of the burner 8. Sensors 85 to 87 are shown in FIG. 1 at 104. The air passes through exhaust filters 21 and is fed by the fans 24 to the exterior through the weighted valves 27 previously described. A pressure difference sensor 88 is also provided for the output filters 21 which sensor is again connected to the control unit 80 to provide warning and/or cut-off if the filters 21 should become clogged. A temperature sensor 89 is also provided in the heat exchanger 7 for determining the temperature of the air flowing there through.

In addition the heat which is generated by the lights 58 in the upper part of the booth is transferred, in the embodiment shown, to the exhaust air leaving the booth. However it is possible to use this heated air to add to the intake air provided in the air handling module as has been previously described.

Once the spraying operation has been completed, the module is set to provide an increased temperature for the curing operation, the additional heat necessary being provided by a reduction in the air supply (by slowing down the fans 14 and 24) and if necessary increasing the operation of the burner 8. During the curing operation, air in the booth is changed at the rate of 1.75 times per minute and the temperature of the incoming air is of the order of 110° C., giving a curing temperature in the booth of 80° C.

During the curing operation, heat reclaimation can be carried out using the heat reclamation module as previously described. It will be noted that with a slow speed of the fans 24, the outlet valve **27*b*** will be closed.

Since the two units are factory produced, assembly of the refinishing unit is a simple matter, the spray booth being merely unloaded onto a suitable site together with the air handling module. The air handling module is pushed up against the side of the booth and the various connections between the two units and between the exterior supplies and the air handling module, together with the compressed air supply to the booth, being made. Once the units have been tested for correct operation, the unit can be put immediately into use.

Figure 5:
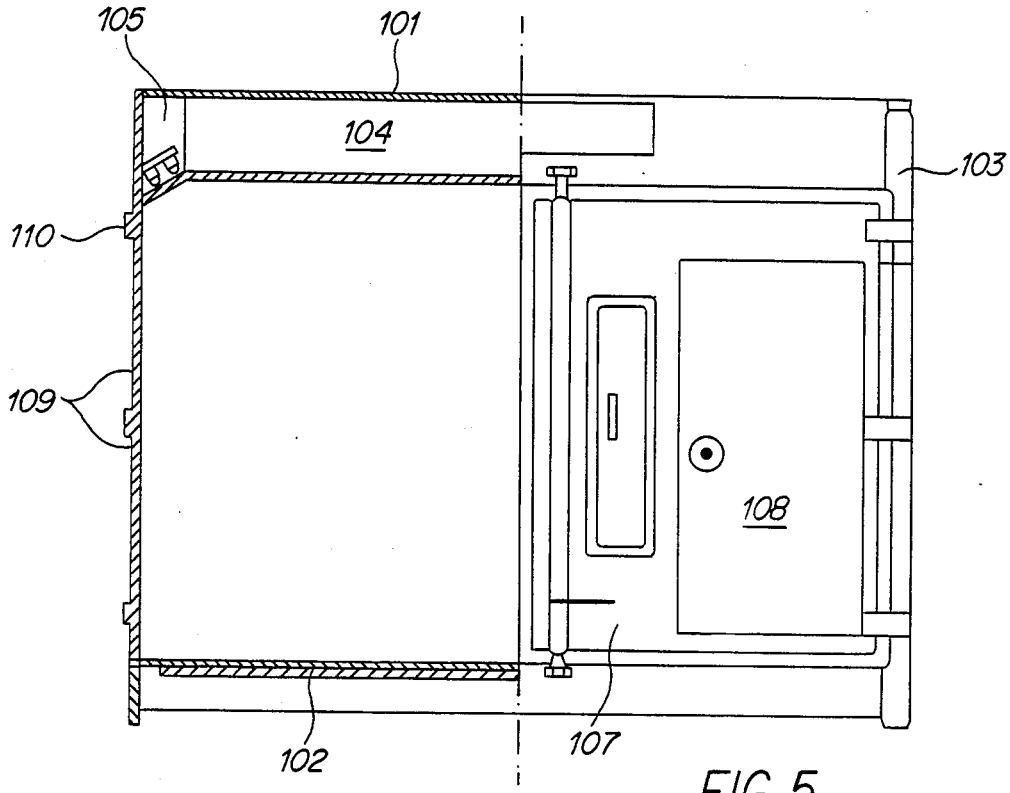
FIG. 5 is a partial end elevation and a partial section of an alternative form of spray booth in accordance with the invention.
Figure 6:
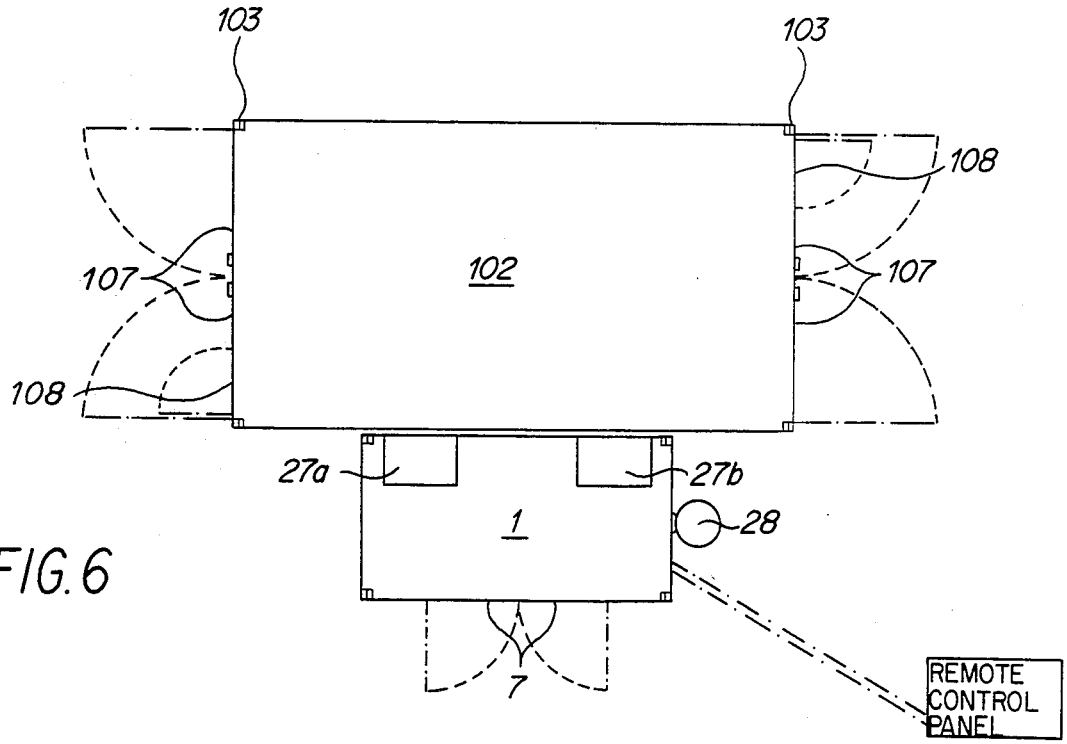
FIG. 6 is a plan view of the spray booth shown in FIG. 5.

FIGS. 5 and 6 shows a variation of the spray booth shown in FIGS. 2 and 3.

As in the first embodiment, the booth has a roof portion 101 and a floor portion 102. These are supported in the four corners by pillars 103 which supplies the sole support for the roof portion 101. The roof portion 101, as before, comprises a large area input chamber 104 for the heated air. However, in this case, the lighting arrangements 105 are entirely separate and cooling thereof is carried out by the use of air movers driven by compressed air.

The floor portion 102 of the booth has the same general form as previously and has therefore not been shown in detail.

Access doors 107 are provided at both ends so that vehicles can pass through the booth. However, in this embodiment the personal doors have been removed from the sides of the structure, where they cause a weakness, and our now positioned, as shown at 108, in one of the main doors 107 at each end. Not only does this allow ready access but enables the user to go straight into a building where the booth is located, for example, at the rear of a garage.

The panel structure of the walls is, as before, not part of the support of the booth. The panels 109 themselves may be divided both vertically and longitudinally with overlapping strengthening parts 110.

It will be appreciated that various modifications may be made to the above described embodiment without departing from the scope of the invention. For example, while the layout of their air handling module has been specifically designed to enable it to take up a relatively small space, it will be appreciated that variation in this design is possible if desired or if modifications to the operation system are required. For example, the use of a two speed fan arrangement could be dispensed with, two separate fans operating independently being used, one of these fans and the appropriate air channels being shut off when curing temperature is required.

The positions of some of the sensors used could be varied. In particular the sensors 85 and 86 could be placed in the outlet from the heat exchanger 7, at the positions shown at 101, 102 in FIG. 1. While the air extraction has been shown to be provided under a limited area of the floor, extraction could be provided over the whole floor area either as a combined operation or a subsidiary extraction being provided in the less important areas.

As will be appreciated, because the unit is provided with doors at both ends, the possible orientation of the booth can be such as to allow the apparatus pod to be mounted effectively on either side of the booth without the necessity of providing two sets of input connections. The air handling pod may be used separately to the booth so as to provide desired air flow and temperatures to other apparatus and may be used in connection with a permanent booth provided in a building if desired.

Because of the use of the mattress construction, variations of size can be carried out relatively easily. For example, the height of the support columns can be varied to produce booths of different heights. A number of booth units could be connected together so that only external cladding is required and adjoining walls can be omitted. For curtain constructions, the wall panels could be replaced by flexible overlapping certain structures. The provision of add-on structures is also possible, to increase the area of the booth, for example, at the sides.

The filters provided in the booth, particularly those in the floor, are arranged to have easy access so that they can be replaced as required at frequent intervals without the necessity of extensive maintenance operations. Thus the sections of the floor are removable and the filters may be removed and replaced by new elements.

It will be seen from the above that a two unit refinishing apparatus is provided which is fully portable in the portable building sense, which can be set up with the minimum of difficulty and is such that its orientation can be significantly varied without increasing the expenditure on the apparatus.

What is claimed is:

1. A refinishing unit for automobiles, comprising:

a portable, free standing weather proof spray booth and a portable, self-contained air handling module connectable to said booth for providing heated, filtered air to said booth and for exhausting the contaminated exhaust air contained within said booth;

said booth comprising a roof unit for supplying air received from said air handling module to the interior of said booth comprising an input chamber in communication with the interior of said booth, a hot air inlet means for connecting said input chamber with the exterior of said booth and replaceable first dry filter means in said input chamber for filtering the air passing through said input chamber into the interior of said booth and for equally dispersing the air flow from said inlet chamber into and about the interior of said booth; a floor unit having a floor including an air permeable section for allowing the exhaust air to pass therethrough and for supporting an automobile, an under floor chamber means positioned below and in communication with said air permeable section, exhaust air outlet means for connecting said under floor chamber with the exterior of said booth, and secondary replaceable dry filtering means in said under floor chamber for filtering the exhaust air flowing through said air permeable section to said exhaust air outlet means; four support columns for supporting said roof unit above said floor unit; wall means having panels and door means for gaining access to said booth, extending from said floor unit to said roof unit and between said columns for enclosing said booth;

said air handling module comprising an enclosed housing, a door providing access to said housing and having a fresh air inlet with replaceable third dry filter means for filtering the fresh air entering said fresh air inlet, a heat generator positioned within said housing, a heat exchanger connected to said heat generator and heated by said heat exchanger, first fan means connected to said fresh air inlet and to said heat exchanger for supplying fresh air to said heat exchanger for heating the air, heated air outlet means connected to said heat exchanger and to the exterior of said housing, exhaust air intake means connected to the exterior of said housing and replaceable fourth filter means for filtering the air passing through said exhaust air intake means, second exhaust air outlet means connected to the exterior of said housing, second fan means connected between said exhaust intake means and said second exhaust outlet means;

said air handling module heated air outlet means and said exhaust air intake means being respectively connected with said hot air inlet means and said exhaust air outlet means of said booth such that a continuous flow of fresh, filtered and heated air is supplied to the interior of said booth from said air handling module and is expelled as exhaust air from said booth to said air handling module and to the atmosphere through said second exhaust air outlet means by said first and said second fan means respectively; and said air permeable section of said floor unit being positioned with respect to an automobile that is in position for refinishing such that the stream lines of the flow of exhausting air are drawn in around the bottom of the automobile for reducing the turbulence of the exhaust air flow around the body of the automobile.

* * * * *